US010184658B2

(12) United States Patent
Sugioka et al.

(10) Patent No.: US 10,184,658 B2
(45) Date of Patent: Jan. 22, 2019

(54) COMBUSTION APPARATUS

(71) Applicant: RINNAI CORPORATION, Nagoya-shi, Aichi (JP)

(72) Inventors: Shingo Sugioka, Nagoya (JP); Takahiro Ono, Nagoya (JP); Hideo Okamoto, Nagoya (JP)

(73) Assignee: RINNAI CORPORATION, Nagoya-shi (JP)

( * ) Notice: Subject to any disclaimer, the term of this patent is extended or adjusted under 35 U.S.C. 154(b) by 306 days.

(21) Appl. No.: 15/193,707

(22) Filed: Jun. 27, 2016

(65) Prior Publication Data

US 2016/0377282 A1 Dec. 29, 2016

(30) Foreign Application Priority Data

Jun. 29, 2015 (JP) ..... 2015-130147

(51) Int. Cl.

| | |
|---|---|
| ***F23D 14/02*** | (2006.01) |
| ***F23D 14/64*** | (2006.01) |
| ***F23D 14/04*** | (2006.01) |
| ***F23D 14/10*** | (2006.01) |
| ***F23D 14/26*** | (2006.01) |
| ***F23D 14/70*** | (2006.01) |

(52) U.S. Cl.

CPC ..... *F23D 14/02* (2013.01); *F23D 14/045* (2013.01); *F23D 14/105* (2013.01); *F23D 14/26* (2013.01); *F23D 14/64* (2013.01); *F23D 14/70* (2013.01)

(58) Field of Classification Search

None

See application file for complete search history.

(56) References Cited

U.S. PATENT DOCUMENTS 5,099,879 A * 3/1992 Baird ..... F15D 1/02 137/561 A
5,318,438 A * 6/1994 Sugahara ..... F23D 14/045 126/92 R
5,525,054 A * 6/1996 Nakaura ..... F23D 14/045 431/285

(Continued)

FOREIGN PATENT DOCUMENTS

JP 10-288315 A 10/1998
JP 2004-60897 A 2/2004
JP 2014052134 A * 3/2014

OTHER PUBLICATIONS

Mashine translation of JP2004060897, see file "JP2004060897_wipo_translate".*

*Primary Examiner* — Avinash A Savani
*Assistant Examiner* — Martha M Becton
(74) *Attorney, Agent, or Firm* — Westerman, Hattori, Daniels & Adrian

(57) ABSTRACT

A combustion apparatus has a plurality of longitudinally elongated gas burners, each having a burner port on an upper end thereof. A damper is disposed to cover gas inlet ports on an upstream end of an air-fuel mixing tube portion of each of the gas burners. The damper has formed therein ventilation holes for limiting primary air. The ventilation holes overlap, and are smaller than, the gas inlet ports. The damper has #1 ventilation holes having obstacles against which the fuel gas to be ejected from the gas nozzles strike, and #2 ventilation holes without obstacles. Poor combustion such as flame lifting is restricted and combustion noises are reduced.

5 Claims, 6 Drawing Sheets

(56) References Cited

U.S. PATENT DOCUMENTS

| | | | | |
|---|---|---|---|---|
| 6,916,175 | B2 * | 7/2005 | Cho | F23D 14/105 431/285 |
| 2012/0156629 | A1 * | 6/2012 | Akiyama | F23D 14/04 431/354 |
| 2012/0244482 | A1 * | 9/2012 | Homma | F23D 14/46 431/278 |
| 2012/0308945 | A1 * | 12/2012 | Wada | F23C 6/02 431/278 |
| 2013/0149653 | A1 * | 6/2013 | Fukunishi | F23D 14/02 431/278 |
| 2013/0171576 | A1 * | 7/2013 | Akiyama | F23D 14/02 431/354 |
| 2015/0184849 | A1 * | 7/2015 | Akagi | F23D 14/045 431/278 |
| 2015/0253035 | A1 * | 9/2015 | Naitoh | F24H 1/145 122/18.4 |
| 2016/0312999 | A1 * | 10/2016 | Ojiro | F23C 6/047 |

* cited by examiner

COMBUSTION APPARATUS

BACKGROUND OF THE INVENTION

1. Technical Field

The present invention relates to a combustion apparatus comprising a plurality of longitudinally (in the back-and-forth direction) elongated gas burners, each of the gas burners having an air-fuel mixing tube portion, and a burner port on an upper end of the gas burner for ejecting air-fuel mixture from the air-fuel mixing tube portion.

2. Background Art

This kind of combustion apparatus is provided with a plurality of gas nozzles each lying opposite to a gas inlet port which is on an upstream end of the air-fuel mixing tube portion of each of gas burners, and a damper to cover the plurality of gas inlet ports of the plurality of gas burners. The damper has formed therein ventilation holes which overlap the gas inlet ports of the plurality of gas burners. Conventionally, there is known an arrangement in which each of the ventilation holes is provided with obstacles to which fuel gas to be ejected from the gas nozzles strike so as to accelerate the mixing between the fuel gas and primary air (see, for example, JP 2004-60897 A).

According to this known art, thanks to the acceleration of mixing between the fuel gas and the primary air, the distribution (air-fuel ratio distribution), in the longitudinal direction, of the air-fuel ratio of the air-fuel mixture to be ejected from the burner ports can be made uniform in all of the gas burners. However, the frequencies of the combustion vibrations to be generated in longitudinally several positions of each gas burner coincide with the frequencies of the combustion vibrations to be generated in longitudinally the same positions of the other gas burners, thereby increasing the combustion noises.

Further, conventionally there is known an arrangement in which the area of the openings of the ventilation holes to be formed in the damper are made larger in part of the gas burners than in the remaining gas burners (see, for example, JP 1998-288315 A). According to the disclosure therein, there will give rise to a difference, due to the difference in the air-fuel ratio of the air-fuel mixture, between the frequencies of the combustion vibrations in some of the gas burners and the frequencies of the combustion vibrations in the other gas burners. As a result of interference actions due to the difference in frequencies, the combustion noises can be suppressed. However, if the air-fuel ratio of the air-fuel mixture is varied to the air-rich side by enlarging the area of openings of the ventilation holes, flame lifting is likely to occur at the time of high intensity combustion.

SUMMARY

Problems that the Invention is to Solve

In view of the above-mentioned points, this invention has an advantage in providing a combustion apparatus in which, while suppressing the occurrence of poor combustion such as flame lifting, the combustion noises can be reduced.

Means to Solve the Problems

In order to solve the above-mentioned problems, this invention is a combustion apparatus comprising a plurality of longitudinally elongated gas burners, each being disposed laterally in parallel with one another and having an air-fuel mixing tube portion, and a burner port on an upper end of each of the gas burners for ejecting air-fuel mixture from the air-fuel mixing tube portion. The combustion apparatus further comprises: a plurality of gas nozzles, each lying opposite to a gas inlet port on an upstream end of the air-fuel mixing tube portion of each of the gas burners; and a damper to cover the gas inlet ports of the plurality of gas burners, the damper having formed therein a plurality of ventilation holes which overlap the gas inlet ports of the plurality of gas burners. The damper has formed therein as the ventilation holes, in a mixed manner, first ventilation holes having obstacles against which the fuel gas to be ejected from the gas nozzles strike, and second ventilation holes without obstacles.

When the gas burners whose gas inlet ports overlap the first ventilation holes are defined as first gas burners, and the gas burners whose gas inlet ports overlap the second ventilation holes are defined as second gas burners, then in the first gas burners mixing of the fuel gas and primary air is accelerated, so that the air-fuel ratio distribution of the air-fuel mixture to be ejected from the burner ports is unified. In the second gas burners, on the other hand, the air-fuel ratio distribution of the air-fuel mixture to be ejected from the burner ports becomes non-uniform somewhat. And due to non-uniformity of the air-fuel ratio distribution in the second gas burners, difference will be generated between the frequencies of the combustion vibrations that will be generated at several positions in the longitudinal direction of the first gas burners and the frequencies of the combustion vibrations that will be generated at the same positions in the longitudinal direction of the second gas burners. And thanks to the mutual interference effect by this difference in frequencies, the combustion noises can be reduced.

Further, in this invention, each of the gas burners further comprises, in addition to the air-fuel mixing tube portion and the burner port: a flame retention air-fuel mixing tube portion; and a flame retention burner port which is positioned on each lateral side of the burner port for ejecting the air-fuel mixture from the flame retention air-fuel mixing tube portion, in which the air-fuel mixture ejected from the burner port is a lean air-fuel mixture with a leaner fuel concentration than a theoretical air-fuel ratio and in which the air-fuel mixture ejected from the flame retention burner port is a rich air-fuel mixture with a richer fuel concentration than the theoretical air-fuel ratio, thereby constituting a rich-lean combustion burner. The combustion apparatus further comprises, in addition to the gas nozzles: a plurality of flame retention gas nozzles each lying opposite to a flame retention gas inlet port on an upstream end of the flame retention air-fuel mixing tube portion. The damper has formed therein, in addition to the ventilation holes, a plurality of flame retention ventilation holes which overlap the plurality of flame retention gas inlet ports of the plurality of gas burners. The second ventilation holes are formed such that the amount of the primary air to pass therethrough is larger than the amount of the primary air to pass through the first ventilation holes. When the gas burners whose gas inlet ports overlap the first ventilation holes are defined as first gas burners, the gas burners whose gas inlet ports overlap the second ventilation holes are defined as second gas burners, the flame retention ventilation hole that overlaps the flame retention gas inlet port of the first gas burner is defined as a first flame retention ventilation hole, and the flame retention ventilation hole that overlaps the flame retention gas inlet port of the second gas burner is defined as a second flame retention ventilation hole, the second flame retention ventilation holes are formed such that the amount of the primary air to pass therethrough is smaller than the amount of the primary air to pass through the first flame retention ventilation holes.

According to this arrangement, an overall air-fuel ratio of the lean air-fuel mixture to be ejected from the burner ports of the second gas burners becomes air-richer than the air-fuel ratio of the lean air-fuel ratio of the lean air-fuel mixture to be ejected from the burner ports of the first gas burners. As a consequence, the difference becomes larger between such frequencies of the combustion vibrations of the lean air-fuel mixture as are generated in the second gas burners and such frequencies of the combustion vibrations of the lean air-fuel mixture as are generated in the first gas burners, whereby the combustion noises can be effectively reduced. Further, the rich air-fuel mixture to be ejected from the flame retention burner ports of the second gas burners changes in the air-fuel ratio to the gas-rich side due to the limitation of the primary air by the second flame retention ventilation holes. Therefore, even if the air-fuel ratio of the lean air-fuel mixture to be ejected from the burner ports of the second gas burners may be changed to the air-rich side, the amount of such primary air in the lean air-fuel mixture as is consumed in the combustion of the rich air-fuel mixture to be ejected from the flame retention burner port of the second gas burner increases. In this manner, lifting of the lean flame at the time of high intensity combustion (flames to be formed by the combustion of the lean air-fuel mixture) by the second gas burner can be suppressed. Still furthermore, the air-fuel ratio of the rich air-fuel mixture to be ejected from the flame retention burner port of the first gas burner is different from the air-fuel ratio of the rich air-fuel mixture to be ejected from the flame retention burner port of the second gas burner. There will, therefore, be a difference also between such frequencies of the combustion vibrations of the rich air-fuel mixture as are generated in the first gas burner and such frequencies of the combustion vibrations of the rich air-fuel mixture as are generated in the second gas burner. In this manner, the combustion noises can be effectively reduced.

By the way, preferably, the plurality of gas burners are classed into a plurality of groups such that number and combination of groups that are subjected to combustion are made variable. At an end of range of disposing gas burners belonging to a group that has a possibility of being subjected to combustion alone, a specific gas burner that is the first gas burner is disposed. At the time of combustion only of the group to which the specific gas burner belongs, rich flame to be formed by the combustion of the rich air-fuel mixture to be ejected from the flame retention burner port of the specific burner is likely to be lifted. Therefore, the first flame retention ventilation hole that overlaps the flame retention gas inlet port of the specific gas burner is preferably formed such that the amount of the primary air to pass through the first flame retention ventilation hole is smaller than the amount of the primary air to pass through other first flame retention ventilation holes. According to this arrangement, the air-fuel ratio of the rich air-fuel mixture to be ejected from the flame retention burner port of the specific burner changes to the gas-rich side. As a result, the lifting of the rich flame at the time of combustion only of the group to which the specific gas burner belongs can be prevented.

PREFERRED EMBODIMENTS FOR CARRYING OUT THE INVENTION

Figure 1:
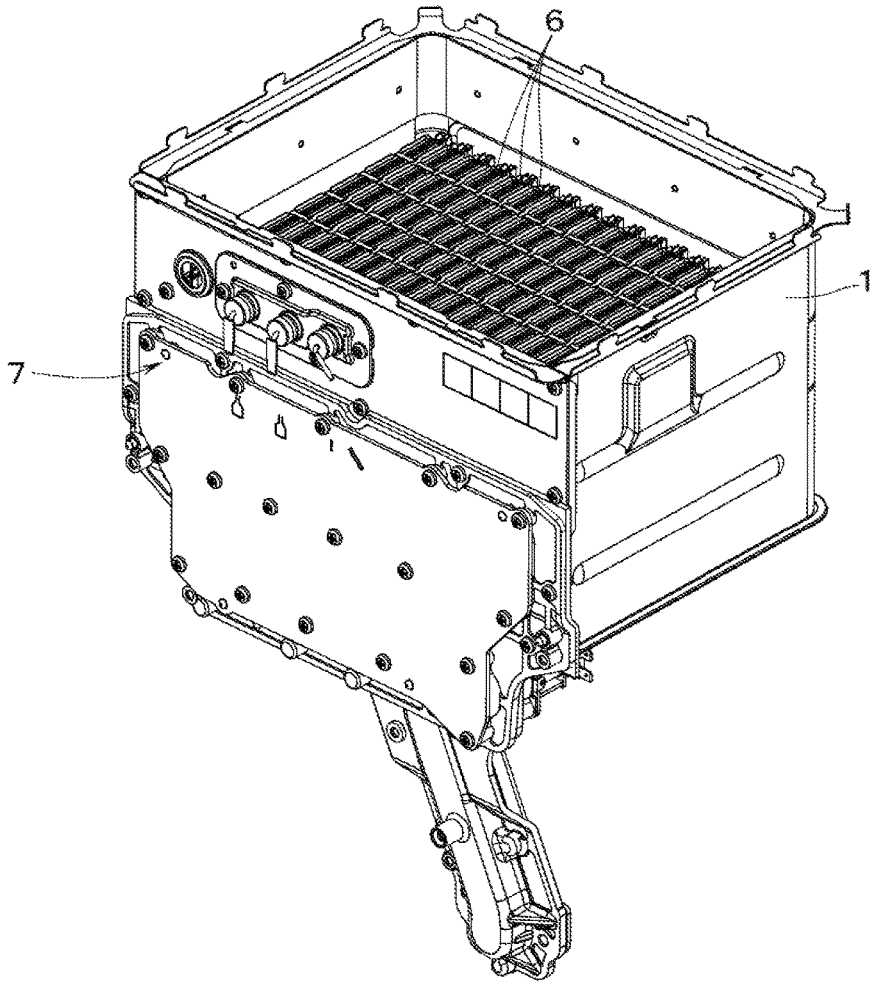
FIG. 1 is a perspective view of a combustion apparatus according to an embodiment of this invention.
Figure 2:
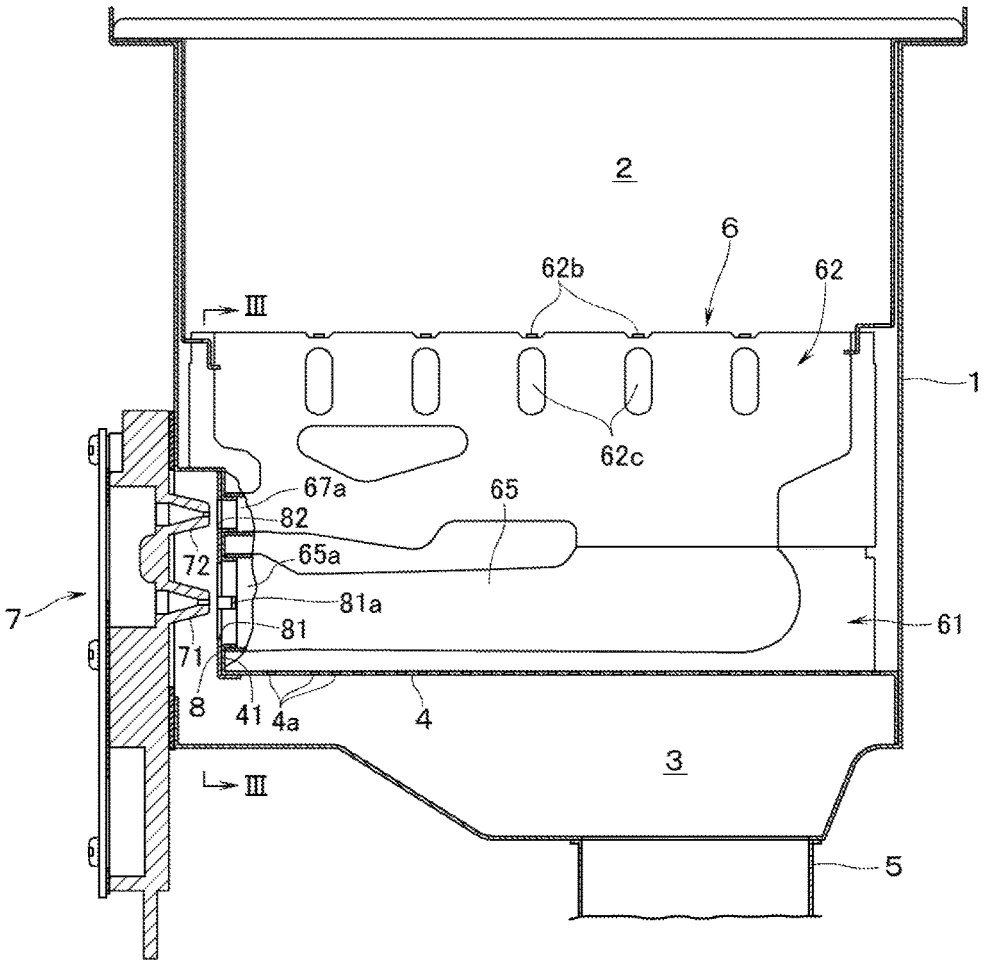
FIG. 2 is a side view partly shown in section of the combustion apparatus according to an embodiment of this invention.
Figure 3:
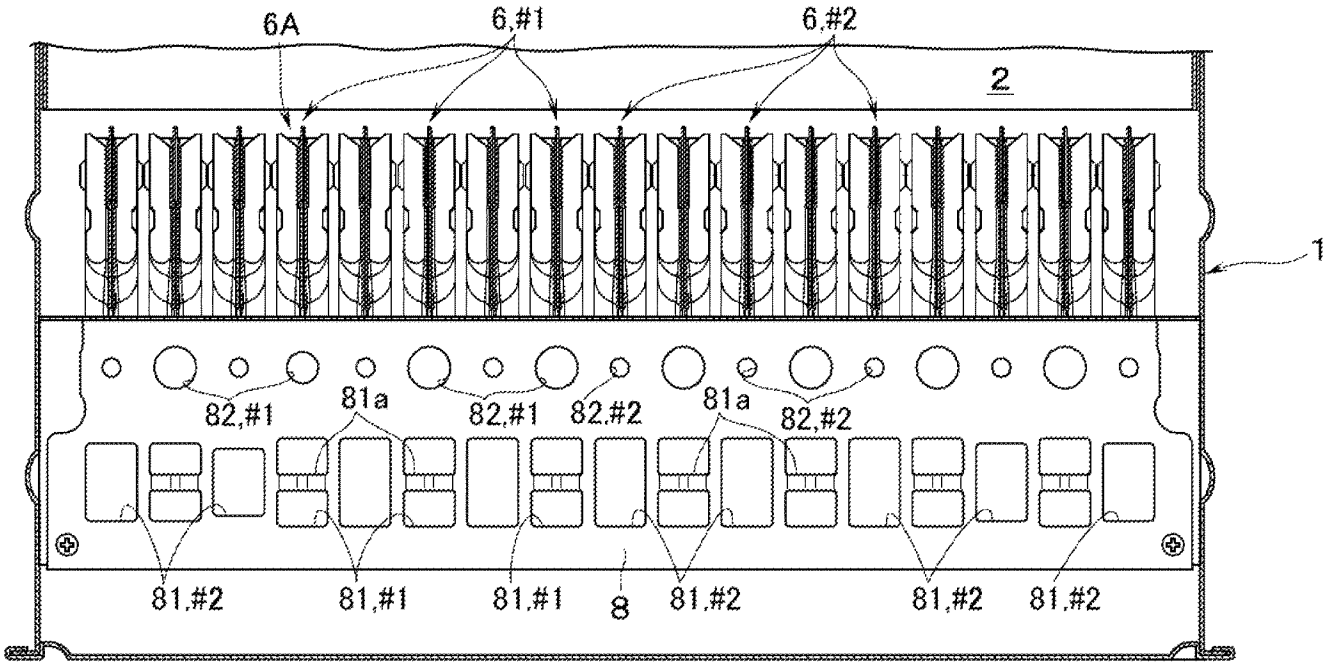
FIG. 3 is a sectional front view taken along the line III-III in FIG. 2.

With reference to FIGS. 1 through 3, the combustion apparatus according to an embodiment of this invention is provided with a combustion box 1. The upper surface of the combustion box 1 is left open. On top of the combustion box 1 there is disposed, as an object to be heated, a heat exchanger (not illustrated) for supplying hot water. Inside the combustion box 1 there is disposed a partition plate 4 which partitions the space inside the combustion box 1 into a combustion chamber 2 and an air supply chamber 3 which lies on a lower side of the combustion chamber 2. To the bottom surface of the air supply chamber 3 there is connected a combustion fan (not illustrated) through a duct 5 so that air can be supplied from the combustion fan to the air supply chamber 3. The partition plate 4 has formed therein a multiplicity of distribution holes 4*a* so that the air supplied to the air supply chamber 3 can be supplied, as secondary air, to the combustion chamber 2 through these distribution holes 4*a*.

Figure 4:
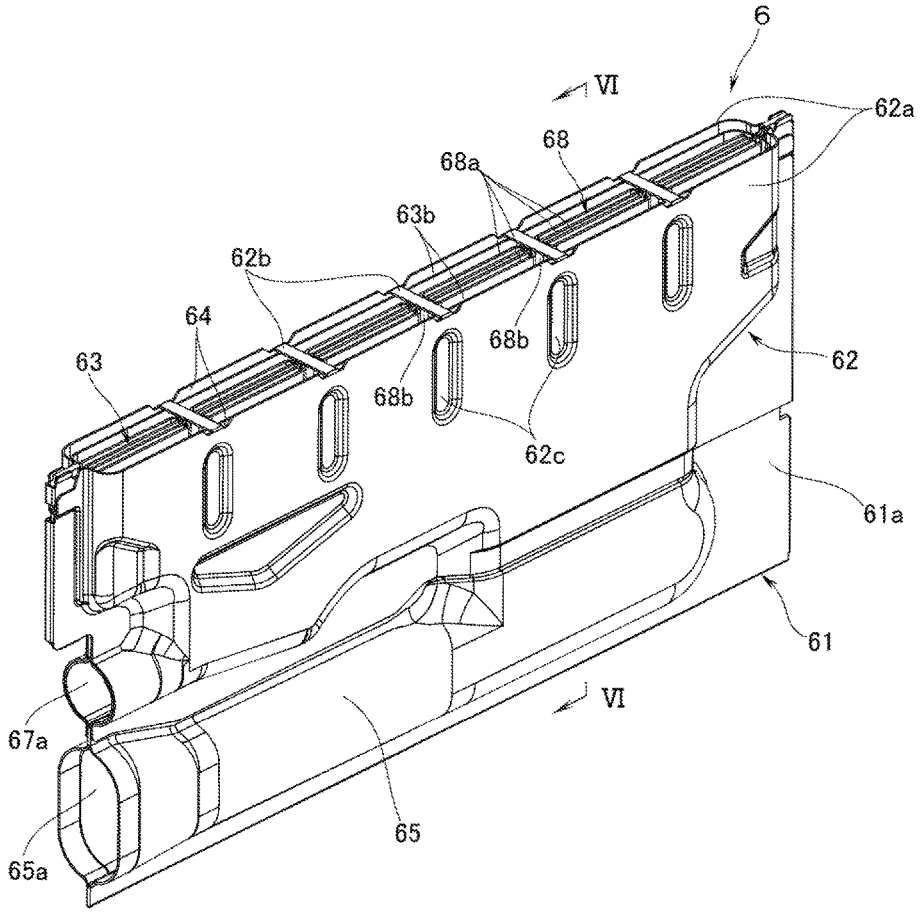
FIG. 4 is a perspective view of a gas burner to be disposed in the combustion apparatus according to an embodiment of this invention.
Figure 5:
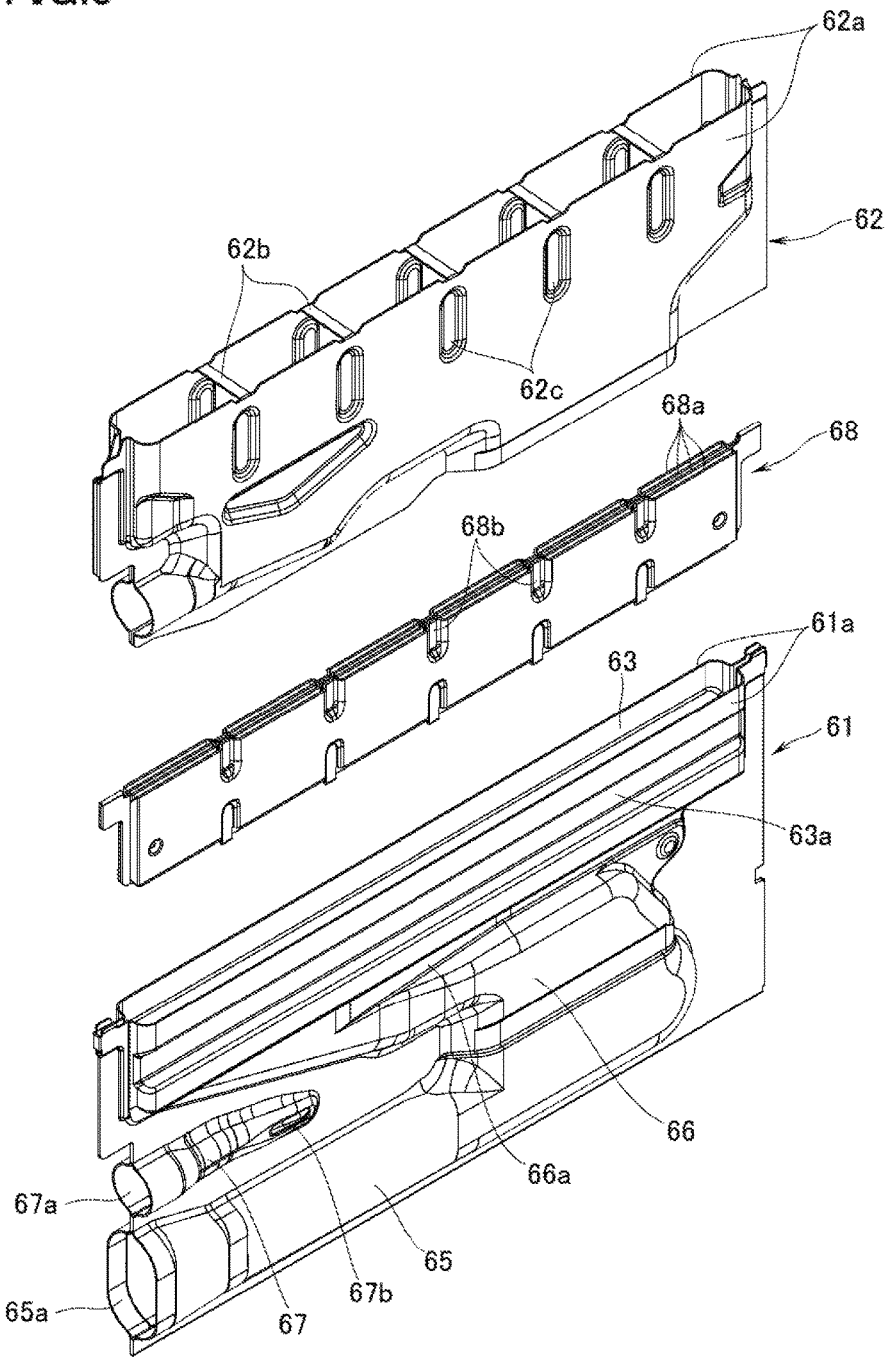
FIG. 5 is an exploded perspective view of the gas burner in FIG. 4.
Figure 6:
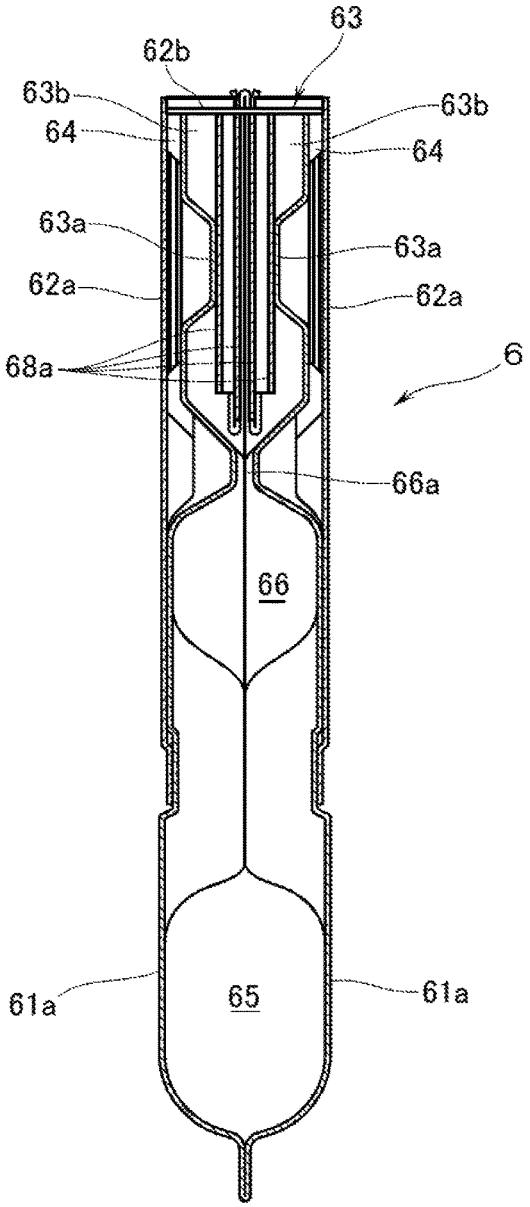
FIG. 6 is a sectional view taken along the line VI-VI in FIG. 4.

In the combustion chamber 2 there are laterally disposed in parallel with one another a plurality (17 pieces in this embodiment) of gas burners 6 which are elongated in the longitudinal (back and forth) direction. Each of the gas burners 6 is provided, as shown in FIGS. 4 through 6, with a burner main body 61, and a burner cap 62 which is covered on an upper part of the burner main body 61. On an upper end of the burner main body 61 there is formed a burner port 63 which is open upward and is of a shape elongated in the longitudinal direction. In addition, by means of the burner cap 62 there are formed flame retention burner ports 64 which are positioned on both sides of the burner port 63. Each of the gas burners 6 is constituted by a rich-lean combustion burner in which lean air-fuel mixture with a leaner fuel concentration than a theoretical air-fuel ratio is ejected from the burner port 63 and in which rich air-feel mixture with a richer fuel concentration than the theoretical air-fuel ratio is ejected from the flame retention burner ports 64.

The burner main body 61 is constituted by a pair of side plates 61*a*, 61*a* which lie laterally opposite to each other (these side plates are hereinafter referred to as "burner-main-body side plates"). These burner-main-body side plates 61*a*, 61*a* are formed by bending a single piece of plate into a rafter roof shape along a bending line which forms a lower edge of the burner main body 61. Then, by means of press-forming of each of the burner-main-body side plates 61*a*, there are formed a burner port 63 on an upper end, an air-fuel mixing tube portion 65 on a lower part, and a distribution chamber portion 66 which introduces the air-fuel mixture from the air-fuel mixing tube portion 65 into the burner port 63. The air-fuel mixing tube portion 65 is elongated backward from a gas inlet port 65*a* which is positioned at a front edge of the lower part of the burner-main-body 61. The distribution chamber portion 66 extends upward from a rear end portion of the air-fuel mixing tube portion 65. On an upper part of the distribution chamber portion 66 there is formed a constricted portion 66*a* in which the lateral width thereof is narrowed. The lateral width of the constricted portion 66*a* gradually expands forward from the portion that is positioned right above the portion at which the air-fuel mixing tube portion 65 and the distribution chamber portion 66 are connected together. According to this arrangement, the flow amount distribution, in the longitudinal direction, of the air-fuel mixture that flows into the burner port 63 will be unified. In addition, at the front portion of the burner main body 61, there is formed a flame retention air-fuel mixing tube portion 67 in a position between the air-fuel mixing tube portion 65 and the distribution chamber portion 66. This flame retention air-fuel mixing tube portion 67 slightly extends backward from a flame retention gas islet port 67*a* that is positioned in the front edge of the burner main body 61 and ends up there and, thereafter, a discharge hole 67*b* is formed on a side surface of the rear end portion.

The burner cap 62 has such a pair of side plates 62*a*, 62*a* (these side plates are hereinafter referred to as "burner-cap side plates") as are covered on an outside of a pair of burner-main-body side plates 61*a*, 61*a*, and a plurality of bridge portions 62*b* which are disposed at several positions in the longitudinal direction so as to couple together both the burner-cap side plates 62*a*, 62*a* at their upper edges. Between each of the burner-main-body side plates 61*a* and each of the burner-cap side plates 62*a* of the burner cap 62, there are defined: a flame retention burner port 64 on an upper end; and a passage to introduce, into the flame retention burner port 64, the rich fuel-air mixture that flows outside the burner main body 61 from the flame retention air-fuel mixing tube portion 67 through the discharge hole 67*b*. Further, at a plurality of longitudinal places of the burner-cap side plates 62*a*, there are formed in a manner in contact with the outside surface of the burner-main-body side plate 61*a*, recessed portions 62*c* which segment the Same retention burner port 64 into longitudinal sections.

Further, inside the burner port 63 there are mounted straightening members 68 having a plurality of straightening plates 68*a* which are laterally disposed in parallel with one another. The straightening members 68 have formed contact portions 68*b* in a plurality of longitudinal portions coinciding with the bridge portions 62*b* of the burner cap 62 by bringing the straightening plates 68*a* into contact with each other so as to longitudinally segment the burner port passages that are defined between each of the straightening plates. In addition, the burner ports 63 of the burner main body 61 have formed, in the vertically intermediate position, narrowed sections 63*a* which are formed by pinching the straightening member 68 from laterally both sides thereof. According to this arrangement, between such a portion of the burner-main-body side plate 61*a* as is above the narrowed section 63*a* and the straightening plate 68*a* on the outside, there is defined a blind clearance 63*b* which is free from ejection of lean air-fuel mixture. It is thus so arranged that the lean air-fuel mixture to be ejected from the burner port 63 is re-circulated back to a space above the blind clearance 63*b*, thereby securing flame retention effect.

An erected portion 41 is formed by bending the partition plate 4 at the front edge thereof. Further, a manifold 7 is mounted on the front side of the erected portion 41 in a manner to block the lower front surface of the combustion box 1. The manifold 7 is provided with: a gas nozzle 71 which lies opposite to the gas inlet port 65*a* on an upstream end of the air-fuel mixing tube portion 65 of each of the gas burners 6; and a flame retention gas nozzle 72 which lies opposite to the flame retention gas inlet port 67*a* on an upstream end of the flame retention air-fuel mixing tube portion 67.

On a front surface of the erected portion 41 of the partition plate 4, a damper 8 is disposed to cover the gas inlet port 65*a* and the flame retention gas inlet port 67*a* of each of the gas burners 6. This damper 8 has formed therein: ventilation holes 81 which overlap the gas inlet ports 65*a* of the gas burners 6; and flame retention ventilation holes 82 which overlap the flame retention gas inlet ports 67*a* of the gas burners 6. In this arrangement, the fuel gas that is ejected from each of the gas nozzles 71 and each of the flame retention gas nozzles 72 is supplied through each of the ventilation holes 81 and each of the flame retention ventilation holes 82 to each of the gas inlet ports 65*a* and each of the flame retention gas inlet ports 67*a*. Also the primary air is supplied from the air supply chamber 3 through the clearance to be defined between the erected portion 41 and the manifold 7 and through each of the ventilation holes 81 and each of the flame retention ventilation holes 82 to each of the gas inlet ports 65*a* and to each of the flame retention gas inlet ports 67*a*.

Further, as shown in FIG. 3, the damper 8 has formed therein, as ventilation holes 81, in a mixed manner, #1 (first) ventilation holes 81 having obstacles 81*a* against which the fuel gas to be ejected from the gas nozzles 71 collide or strike, and #2 (second) ventilation holes 81 without obstacles. The obstacles 81*a* are constituted by strap plate portions which are recessed backward in V-shape while traversing the ventilation holes 81 at a vertically middle portion thereof. In this embodiment, the #1 ventilation holes and the #2 ventilation holes 81 are arranged, each kind in an alternate manner, but it is also possible to alternately arrange them in twos or threes in respective groups.

Suppose that the gas burners 6 whose #1 ventilation holes 81 overlap the gas inlet port 65*a* are defined as #1 (first) gas burners 6, and that the gas burners 6 whose #2 ventilation holes 81 overlap the gas inlet port 65*a* are defined as #2 (second) gas burners. Then, in the #1 gas burners 6 the fuel gas collides with the obstacles 81*a*, so that mixing between the fuel gas and the primary air is accelerated. In this manner, the lean air-fuel mixture to be ejected from the burner ports 63 will be unified in the air-fuel ratio distribution. On the other hand, in the #2 gas burners 6 the air-fuel ratio distribution of the lean air-fuel mixture to be ejected from the burner port 63 becomes non-uniform somewhat. Then, due to the non-uniform air-fuel ratio distribution of the lean air-fuel mixture to be ejected from the burner ports 63 of the #2 gas burners 6, there will be generated a difference between such frequencies of the combustion vibrations of the lean air-fuel mixture as are generated in longitudinally several positions of the #1 gas burners 6, and such frequencies of the combustion vibrations of the lean air-fuel mixture as are generated in longitudinally the same positions of the #2 gas burners 6. Thanks to the mutual interference effect due to this difference in the frequencies, the combustion noises can be reduced.

Further, according to this embodiment, the area of opening of the #2 ventilation holes 81 is made larger than the area of opening other than the obstacles 81*a* of the #1 ventilation holes 81 so that the amount of the primary air to pass through the #2 ventilation holes 81 becomes larger than the amount of the primary air to pass through the #1 ventilation holes 81. By the way, laterally one part of the damper 8 is subjected to a relatively high air pressure. In such a part where the air pressure is strongly applied, even if the area of openings of the #2 ventilation holes 81 is smaller than the area of opening of the #1 ventilation holes 81 other than the obstacles 81*a*, the amount of the primary air to pass through the #2 ventilation holes 81 will be larger than the amount of the primary air to pass through the #1 ventilation holes 81. For such reasons, the area of openings of some of the #2 ventilation holes 81 are smaller than the area of openings of the portion other than the obstacles 81*a* in the #1 ventilation holes 81. Further, suppose that the #1 flame retention ventilation holes 82 which overlap the flame retention gas inlet ports 87*a* are defined as the #1 (first) flame retention ventilation holes 82, and that the flame retention ventilation holes 82 which overlap the flame retention gas inlet ports 67*a* of the #2 gas burner 6 are defined as #2 (second) flame retention ventilation holes 82. It is thus so arranged that the area of openings of the #2 flame retention ventilation hole 82 is made smaller than the area of openings of the #1 flame retention ventilation holes 82 so that the amount of the primary air that passes through the #2 flame retention ventilation holes 82 becomes smaller than the amount of the primary air that passes through the #1 flame retention ventilation holes 82.

According to this arrangement, an overall air-fuel ratio of the lean air-fuel mixture to be ejected from the burner ports 63 of the #2 gas burners 6 will be air-richer than the air-fuel ratio of the lean air-fuel mixture to be ejected from the burner ports 63 of the #1 gas burners 6. Then, due to the difference in the overall air-fuel ratios of the lean air-fuel mixture, the difference between such frequencies of combustion vibrations of the lean air-fuel mixture as are generated by the #2 gas burners 6 and such frequencies of combustion vibrations of the lean air-fuel mixture as are generated by the #1 gas burners 6 becomes larger, so that the combustion noises can effectively be reduced.

When the air-fuel ratio of the lean air-fuel mixture is changed to the air-rich side, the lean flame to be formed by the combustion of the lean air-fuel mixture is likely to be lifted at the time of high intensity combustion. In this embodiment, however, the air-fuel ratio of the rich air-fuel mixture to be ejected from the flame retention burner ports 64 of the #2 gas burners 6 will be changed toward the gas-rich side due to limitation of the primary air by the #2 flame retention ventilation holes 82. Therefore, even if the air-fuel ratio of the lean air-fuel mixture to be ejected from the burner ports 63 of the #2 gas burners 6 is changed to the air-rich side, the amount of such primary air in the lean air-fuel mixture as is consumed in the combustion of the rich air-fuel mixture to be ejected from the flame retention burner ports 64 of the #2 gas burners 6, will increase. Consequently, lifting of the lean flame at the time of high intensity combustion by the #2 gas burners 6 can be suppressed.

Further, the air-fuel ratio of the rich air-fuel mixture to be ejected from the flame retention burner ports 64 of the #1 gas burners 6 is different from the air-fuel ratio of the rich air-fuel mixture to be ejected from the flame retention burner ports 64 of the #2 gas burners 6. Therefore, there will be generated a difference also between such frequencies of combustion vibrations of the rich air-fuel mixture as are generated by the #1 gas burners 6 and such frequencies of combustion vibrations of the rich air-fuel mixture as are generated by the #2 gas burners 6. The combustion noises can thus be more effectively reduced.

By the way, the 17 gas burners 6 in the combustion chamber 2 are grouped into the following four groups, i.e.: the first group made up of the first to the third (i.e., three) gas burners 6 as counted from the left in FIG. 3; the second group made up of the fourth and the fifth (i.e., two) gas burners 6; the third group made up of the sixth to the eighth (i.e., three) gas burners 6; and the fourth group made up of the ninth to the seventeenth (i.e., nine) gas burners 6. It is then so arranged that the number and the combination of groups to be subjected to combustion are varied depending on the hot water supply load. In concrete, switching can be made from among: the state in which only the second group is subjected to combustion: the state in which both the second and the third groups are subjected to combustion; the state in which the first, the second, and the third groups are subjected to combustion; the state in which the third and the fourth groups are subjected to combustion; and the state in which all of the groups from the first to the fourth groups are subjected to combustion.

Here, on the left end of range of disposing the gas burners 6 that belong to the second group, i.e., the group that is possibly subjected to combustion alone, there is disposed a specific gas burner 6A, that is a #1 gas burner 6. At the time of combustion of only the second group, the flame retention burner port 64 on the left side of the specific gas burner 6A will be cooled by the secondary air flow that flows along the left side of the specific gas burner 6A, without being heated by the flame of the gas burners 6 of the first group. In addition, the secondary air is excessively supplied to the rich air-fuel mixture to be ejected from the flame retention burner port 64 on the left side of the specific gas burner 6A, without being consumed by the gas burner 6 on the left side of the specific gas burner 6A. Therefore, if the amount of the primary air to flow through the flame retention ventilation hole 82 that overlaps the flame retention gas inlet port 67*a* of the specific gas burner 6A is equal to the amount of the primary air to flow through another #1 flame retention ventilation hole 82, at the time of combustion of only the second group, the rich flame to be formed by the combustion of the rich air-fuel mixture to be ejected from the flame retention burner port 64 on the left side of the specific gas burner 6A is likely to be lifted.

As a solution, in this embodiment, the area of opening of the #1 flame retention ventilation hole 82 that overlaps the flame retention gas inlet port 67*a* of the specific gas burner 6A is arranged to be smaller than the area of opening of another #1 flame retention ventilation hole 82. As a result, the amount of the primary air to flow through the flame retention ventilation hole 82 that overlaps the flame retention gas inlet port 67*a* of the specific gas burner 6A becomes smaller than the amount of the primary air to pass through another #1 flame retention ventilation hole 82. According to this arrangement, the air-fuel ratio of the rich air-fuel mixture to be ejected from the flame retention burner port 64 of the specific gas burner 6A mil be changed to the gas-rich side. The lifting of the rich flame of the specific gas burner 6A at the time of combustion only of the second group can thus be prevented.

Explanation has so far been made of an embodiment of this invention with reference to the figures. This invention shall, however, be not limited to the above. For example, the gas burners 6 in the above-mentioned embodiment are rich-lean burners provided with burner caps 62. However, this invention may similarly be applicable to a combustion apparatus provided with a gas burner which is other than rich-lean burners and in which the burner caps are omitted.

EXPLANATION OF MARKS

6 gas burner
6A specific gas burner

63 burner port
64 flame retention burner port
65 air-fuel mixing tube portion
65*a* gas inlet port
67 flame retention air-fuel mixing tube portion
67*a* flame retention gas inlet port
71 gas nozzle
72 flame retention gas nozzle
8 damper
81 ventilation hole
81*a* obstacle
82 flame retention ventilation hole

What is claimed is:

1. A combustion apparatus comprising a plurality of longitudinally elongated gas burners, each being disposed laterally in parallel with one another and having an air-fuel mixing tube portion, a burner port on an upper end of each of the gas burners for ejecting air-fuel mixture from the air-fuel mixing tube portion, a flame retention air-fuel mixing tube portion, and a flame retention burner port which is positioned on each lateral side of the burner port for ejecting the air-fuel mixture from the flame retention air-fuel mixing tube portion, the combustion apparatus further comprising:

a plurality of gas nozzles, each lying opposite to a gas inlet port on an upstream end of the air-fuel mixing tube portion of each of the gas burners; and a damper to cover the gas inlet ports of the plurality of gas burners; a damper having formed therein a plurality of ventilation holes, each of which overlaps the gas inlet port on the upstream end of the air-fuel mixing tube portion of each of the gas burners, wherein the damper has formed therein as the ventilation holes, in a mixed manner, first ventilation holes having obstacles against which the fuel gas to be ejected from the gas nozzles strike, and second ventilation holes without obstacles.

2. The combustion apparatus according to claim 1, wherein the air-fuel mixture ejected from the burner port is a lean air-fuel mixture with a leaner fuel concentration than a theoretical air-fuel ratio, wherein the air-fuel mixture ejected from the flame retention burner port is a rich air-fuel mixture with a richer fuel concentration than the theoretical air-fuel ratio, wherein the combustion apparatus further comprises a plurality of flame retention gas nozzles each lying opposite to a flame retention gas inlet port on an upstream end of the flame retention air-fuel mixing tube portion, wherein the damper has formed therein a plurality of flame retention ventilation holes which overlap the plurality of flame retention gas inlet ports of the plurality of gas burners, wherein the second ventilation holes are formed such that the amount of the primary air to pass therethrough is larger than the amount of the primary air to pass through the first ventilation holes, and when the gas burners whose gas inlet ports overlap the first ventilation holes are defined as first gas burners, the gas burners whose gas inlet ports overlap the second ventilation holes are defined as second gas burners, the flame retention ventilation hole that overlaps the flame retention gas inlet port of the first gas burner is defined as a first flame retention ventilation hole, and the flame retention ventilation hole that overlaps the flame retention gas inlet port of the second gas burner is defined as a second flame retention ventilation hole, wherein the second flame retention ventilation holes are formed such that the amount of the primary air to pass therethrough is smaller than the amount of the primary air to pass through the first flame retention ventilation holes.

3. The combustion apparatus according to claim 2, wherein the plurality of gas burners are classed into a plurality of groups such that the number and combination of groups that are subjected to combustion are made variable and wherein, at an end of range of disposing gas burners belonging to a group that has a possibility of being subjected to combustion alone, a specific gas burner that is the first gas burner is disposed, and wherein the first flame retention ventilation hole that overlaps the flame retention gas inlet port of the specific gas burner is formed such that the amount of the primary air to pass through the first flame retention ventilation hole is smaller than the amount of the primary air to pass through other first flame retention ventilation holes.

4. A combustion apparatus comprising:

a plurality of longitudinally elongated gas burners, each being disposed laterally in parallel with one another, and each having an air-fuel mixing tube portion, a burner port on an upper end of each of the gas burners for ejecting an air-fuel mixture from the air-fuel mixing tube portion, a flame retention air-fuel mixing tube portion, and a flame retention burner port which is positioned on each lateral side of the burner port for ejecting an air-fuel mixture from the flame retention air-fuel mixing tube portion;

a plurality of gas nozzles, each lying opposite to a gas inlet port on an upstream end of the air-fuel mixing tube portion of each of the gas burners;

a plurality of flame retention gas nozzles, each lying opposite to a gas inlet port on an upstream end of the flame retention air-fuel mixing tube portion of each of the gas burners; and a damper to cover the gas inlet ports of the plurality of gas burners, the damper including first ventilation holes having obstacles against which fuel gas to be ejected from the gas nozzles strike, second ventilation holes without obstacles, and third ventilation holes, the first ventilation holes and the second ventilation holes overlapping the gas inlet ports on the upstream end of the air-fuel mixing tube portions, the third ventilation holes overlapping the gas inlet ports on the upstream end of the flame retention air-fuel mixing tube portion, wherein the first ventilation holes and the second ventilation holes are in a mixed arrangement across the gas inlet ports on the upstream end of the air-fuel mixing tube portions, and wherein adjacent ones of the third ventilation holes have different sizes.

5. The combustion apparatus according to claim 4, wherein the adjacent ones of the third ventilation holes have a first size and a second size larger than the first size, respectively, and wherein the third ventilation holes having the second size are located above the first ventilation holes, and wherein the third ventilation holes having the first size are located above the second ventilation holes.

* * * * *